US005746787A

United States Patent [19]

Koppelman

[11] Patent Number: 5,746,787

[45] Date of Patent: May 5, 1998

[54] PROCESS FOR TREATING CARBONACEOUS MATERIALS

[75] Inventor: Edward Koppelman, Encino, Calif.

[73] Assignee: KFx Inc., Denver, Colo.

[21] Appl. No.: 738,524

[22] Filed: Oct. 28, 1996

[51] Int. Cl.[6] ..... C10L 9/00

[52] U.S. Cl. ..... 44/621; 44/629; 422/201; 422/307

[58] Field of Search ..... 44/620, 621, 626, 44/629; 422/200, 201, 307

[56] References Cited

U.S. PATENT DOCUMENTS 2,897,054 12/1959 Miley .
3,520,067 7/1970 Winegartner .
4,052,168 10/1977 Koppelman .
4,089,656 5/1978 Cole .
4,285,140 8/1981 van Raam et al. .
4,505,211 3/1985 Lamare .
4,523,927 6/1985 Kuge et al. .
4,601,113 7/1986 Draper et al. .
4,626,258 12/1986 Koppelman .
4,788,360 11/1988 Calemma et al. ..... 44/620
4,980,029 12/1990 Bolz et al. .
5,071,447 12/1991 Koppelman .
5,290,523 3/1994 Koppleman .

*Primary Examiner*—Prince Willis, Jr.
*Assistant Examiner*—Cephia D. Toomer
*Attorney, Agent, or Firm*—Harness, Dickey & Pierce, P.L.C.

[57] ABSTRACT

The invention described herein relates to a process for treating carbonaceous material wherein the resulting product is resistant to undesired combustion. According to the process, carbonaceous material is treated with a gaseous mixture comprising a major amount of inert gas and a minor amount of oxygen either during or subsequent to carrying out the upgrading step to at least partially oxidize the carbonaceous material.

18 Claims, 6 Drawing Sheets

PROCESS FOR TREATING CARBONACEOUS MATERIALS

BACKGROUND OF THE INVENTION

The present invention relates to a process for treating carbonaceous materials and, more particularly, upgrading carbonaceous materials wherein the resulting product is resistant to undesired combustion which tends to occur, for example, during periods of storage or shipment. The process of the present invention can be carried out using various apparatus for upgrading naturally occurring carbonaceous materials.

A number of inventions relating to upgrading carbonaceous fuel have heretofore been used or proposed so as to render carbonaceous fuels more suitable as a solid fuel. While such systems are generally effective at increasing the btu values of the carbonaceous materials, effectuating a reduction in the non-volatile content of the material or offer an economical means of obtaining large quantities of high grade carbonaceous materials, the resulting upgraded carbonaceous materials are often susceptible to undesired combustion after relatively short periods of time following the upgrading process.

Undesired combustion can occur under a number of circumstances including, but not limited to, contact by a source of ignition, i.e. static electricity, which may occur during shipment or storage. Perhaps more commonly, undesired combustion occurs as a result of the spontaneous combustion of the upgraded carbonaceous material.

While the upgraded carbonaceous materials can be chemically treated with various flame retardant agents to reduce the likelihood of undesired combustion occurring, chemical treatment with flame-retardant materials may inhibit the fuel's effectiveness when the fuel is used for its intended purpose. Further, upgraded carbonaceous materials treated with a flame retardant material would likely require additional chemical treatment to negate the effects of any flame retardant employed, prior to use, thus, unnecessarily increasing the cost of using the upgraded carbonaceous material as a fuel source.

SUMMARY OF THE INVENTION

The benefits and advantages of the present invention are achieved by a process wherein carbonaceous material is sufficiently oxidized, either during the upgrading process or subsequent thereto, so as to reduce the likelihood of undesired combustion occurring. Ideally, the process will be carried out using an apparatus for upgrading carbonaceous material such as those disclosed in U.S. Pat. No. 5,290,523 which issued Mar. 1, 1994, or co-pending U.S. patent application Ser. No. 08/513,199, which was filed Aug. 8, 1995, each of which are hereby incorporated by reference.

The apparatus employed to carry out the process of the present invention should have a relatively simple design, have a durable construction, be versatile in use and readily adapted for processing different carbonaceous materials. Further, the apparatus employed should be simple to control and efficient in the utilization of heat energy, thereby providing for economical operation and a conservation of resources.

A major advantage of the present invention over the systems for treating carbonaceous materials which are known is that the resulting product not only has a high energy value and reduced by product content, but also is resistant to undesired combustion.

BRIEF DESCRIPTION OF THE DRAWINGS

Additional benefits and advantages of the present invention will become apparent from a reading of the description of the preferred embodiments taken in conjunction with the specific examples provided and the drawings, in which.

DETAILED DESCRIPTION OF THE PREFERRED EMBODIMENT

The process of the present invention relates to the treatment of carbonaceous materials including but not limited to, ground coal, lignite and sub-bituminous coals of the type broadly ranging between wood, peat and bituminous coals wherein the resulting products are resistant to undesired combustion. In addition to obtaining carbonaceous materials which are resistant to undesired combustion, the resulting upgraded carbonaceous materials typically have reduced amounts of by-products contained in the final product as compared to upgraded carbonaceous materials obtained by other known processes.

Figure 1:
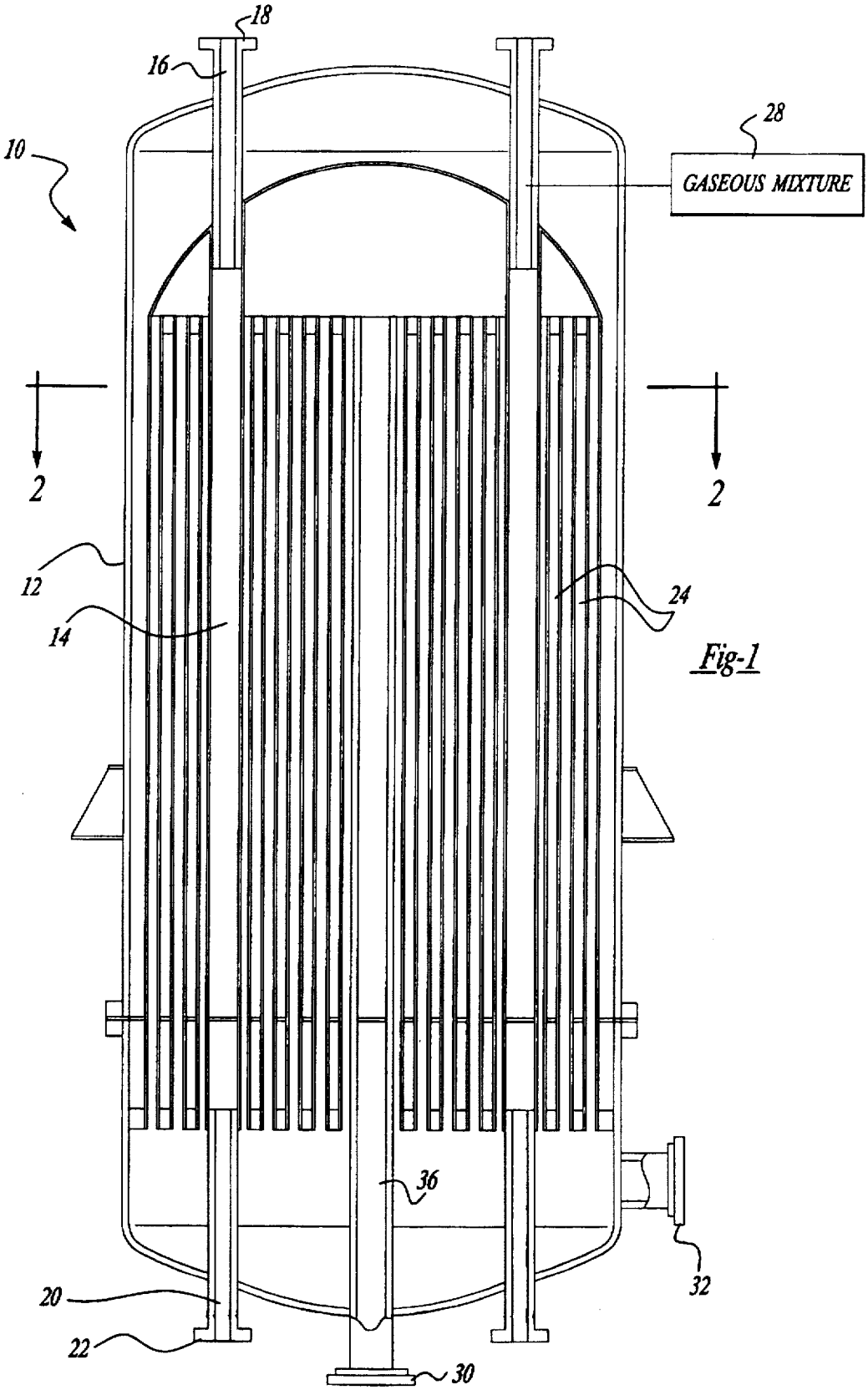
FIG. 1 is a side elevation view of a first heat exchanger embodiment useful to carry out a process in accordance with the teachings of the present invention.
Figure 2:
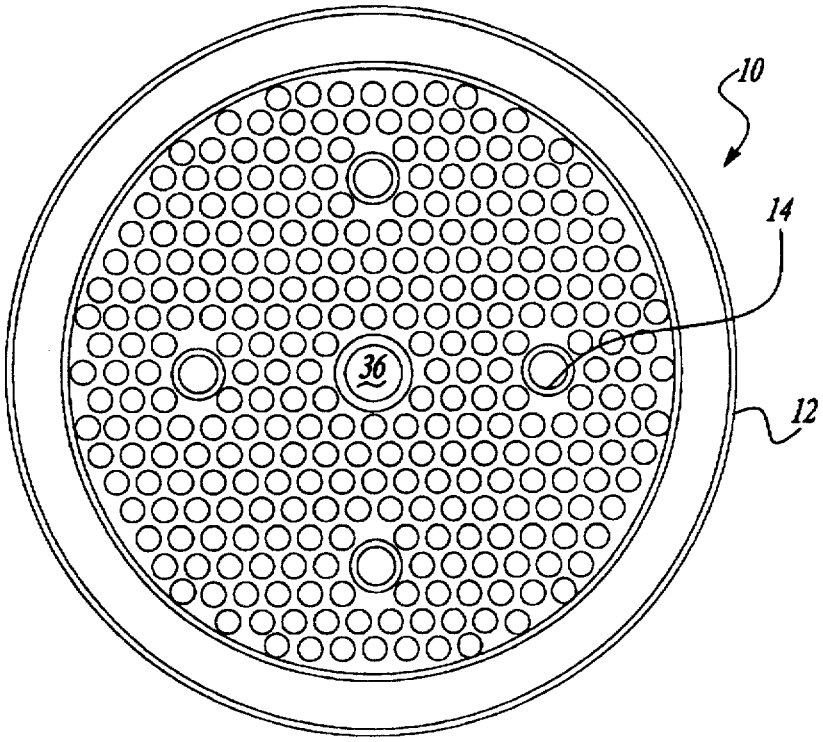
FIG. 2 is a sectional view taken along line 2—2 of FIG. 1.

Referring to FIG. 1, there is shown a heat exchanger apparatus 10 useful to carry out the process of the present invention. The heat exchanger generally includes a casing 12, having a plurality of tubes 14 contained therein typically extending the length of the casing for retaining the carbonaceous material. Each tube 14 is provided with an inlet 16 having a valve 18 and an outlet 20 including valve 22. The heat exchanger 10 also includes a network for circulating a heat exchange medium throughout the casing including a plurality of channels 24 extending lengthwise within the casing. The network includes an inlet 30 for introducing a heat exchange medium into the casing 12 and an outlet 32 for removing the heat exchange medium from the casing after circulation therethrough. Ideally, the heat exchange medium will be cycled through a furnace (not shown) to reheat the heat exchange medium prior to reintroduction into the heat exchanger.

To carry out the process for treating carbonaceous material wherein the resulting product is resistant to undesired combustion, utilizing the heat exchanger of FIG. 1, carbonaceous material is charged into the plurality of tubes 14 through inlets 16 after closing the valves 22 located along the outlets 20. Upon filling the tubes with the desired amount of carbonaceous material, the valves 18 located along the inlets 16 are closed to maintain the carbonaceous material in a closed system.

As noted, a relatively wide range of carbonaceous materials can be processed in accordance with the teachings of the present invention. Regardless of the type of carbonaceous material being processed, generally the carbonaceous material will include up to about 30.0 wt. % moisture as received. The present process advantageously converts the moisture contained in the carbonaceous material into super heated steam which in turn is used to drive by-products from the carbonaceous material.

A heat exchange medium such as heated gas, molten salt, or preferably an oil, having a temperature of between about 250° F. to 1200° F., and preferably about 750° F., is circulated, preferably continuously, throughout the casing by introducing the heat exchange medium through the inlet 30. The heat exchange medium travels upwardly through the well 36 and then back down through the plurality of channels 24. The heat exchange medium then exits the outlet 32 for reheating prior to being reintroduced through inlet 30.

Once the carbonaceous material is preheated, a gaseous mixture including a major amount of inert gas and a minor amount of oxygen is injected into the plurality of tubes through inlets 28. The gaseous mixture, which preferably is injected as a single shot at a pressure of about 150 PSIG such that the tube or chamber containing the carbonaceous material is filled, serves a dual purpose in that the inert gas acts as a heat transfer carrier by coming into contact with the inner walls of the tubes 14, absorbing heat and driving the heat into the carbonaceous material. Additionally, the oxygen assists in at least partially oxidizing the carbonaceous material. While, the pressure at which the gaseous mixture is introduced into the tubes 14 is generally about 150 PSIG, the initial pressure at which the gaseous mixture is introduced can range from about 50 PSIG to about 250 PSIG. By introducing the gaseous mixture at pressures within the aforementioned range, the system pressure, which occurs as a result of the upgrading process, may rise to approximately 3,000 PSIG, prior to completion of the upgrading process. After a predetermined amount of time, i.e. up to about thirty minutes, the upgraded carbonaceous material is removed from the heat exchanger.

The gaseous mixture most broadly includes a major amount of inert gas and a minor amount of oxygen. Preferably, however, the gaseous mixture includes up to about 20.0% oxygen based on the total volume of the mixture and, more preferably, between about 5.0% to about 15.0% oxygen by volume with the remainder being a known inert gas or mixture of inert gases. Preferably, the inert gas component will include at least about 60.0% nitrogen by volume and, more preferably, at least about 80.0% by volume based on the total of the inert gas.

The upgraded carbonaceous material, as will be described in greater detail below is generally more resistant to undesired combustion than upgraded carbonaceous materials formed by other known processes. Further, the material includes relatively few by-products and typically has a heating value of approximately 12,000 btu/lb.

Figure 4:
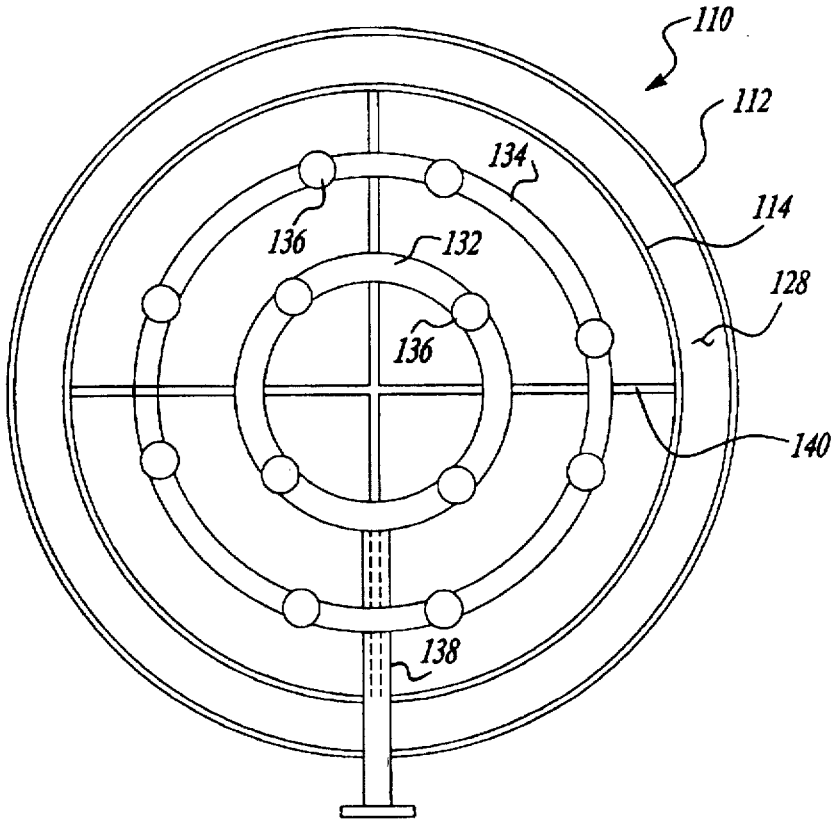
FIG. 4 is a sectional view taken along line 4—4 of FIG. 3.
Figure 3:
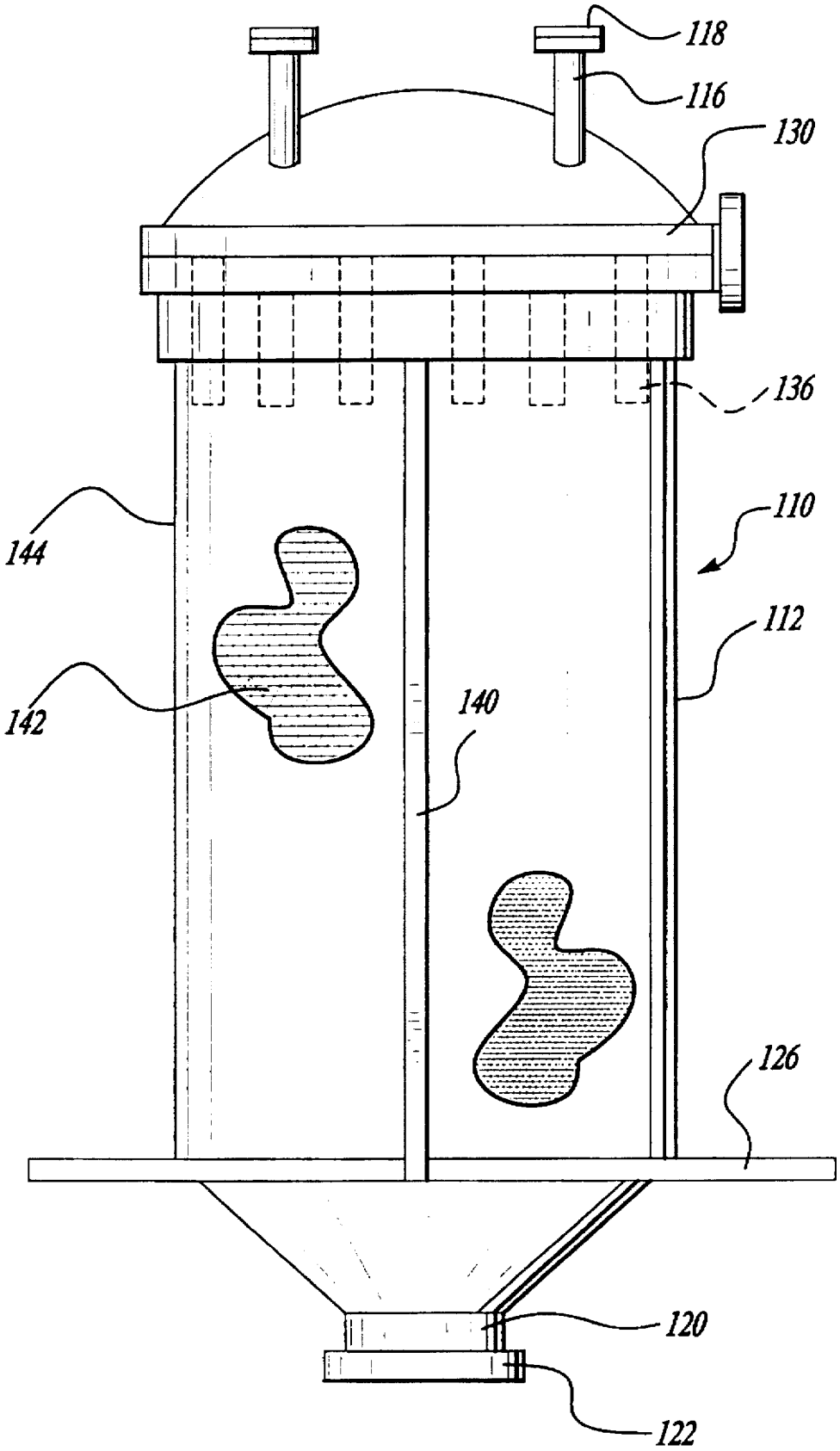
FIG. 3 is a side elevation view partially broken away illustrating a second heat exchanger embodiment useful to carry out a process in accordance with the teachings of the present invention.

Referring now to FIG. 3, an alternative embodiment of a heat exchanger apparatus 110 useful to carry out the process of the present invention is disclosed which comprises an outer casing 112 having a relatively cylindrical shaped chamber 114 contained therein as shown more clearly in FIG. 4. The chamber 114 generally extends along a significant length of the casing 112 and serves to retain the carbonaceous material during the treatment process. Internally, the chamber 114 is provided with a divider 140 which separates the chamber into a plurality of elongated sections for segregating the carbonaceous material prior to treatment, each section generally having roughly the same volumetric capacity as any other given section. The heat exchanger 110 also includes one or more inlets 116 having valves 118 for introducing a charge of carbonaceous material into the various sections of the chamber and one or more outlets 120 having valves 122 for removing the carbonaceous material from the heat exchanger after treatment. Located proximate to the lower end of the casing 112 above valve 122 is a valve 126 which is actuable to close off the chamber 114 while treating the carbonaceous material. Preferably, a gap 128 is provided between the inner wall of the casing and the outer wall of the chamber within which insulation material 142 as shown in FIG. 3 is disposed to retain the heat within the heat exchanger. Still further, means for circulating a heat exchange medium (not shown) such as heat gas, molten salt or an oil may be provided throughout the gap to assist reusing the temperature of the carbonaceous materials to approximately 750° F. prior to introducing the gaseous mixture.

The heat exchanger apparatus 110 further includes a steam injector 130 disposed along the top of the chamber 114 for optionally introducing steam into the various sections of the chamber. As illustrated most clearly in FIG. 4, the steam injector typically includes an inner ring 132 and an outer ring 134, each of which has a plurality of downwardly extending nozzles 136 for introducing the steam into the various sections of the chamber in an area specific manner. The inner and outer rings are joined by at least one conduit 138 into which the steam is originally introduced.

The gaseous mixture including a major amount of inert gas and a minor amount of oxygen can be introduced into the chamber containing the carbonaceous material either through the injector 130 or through a separate inlet 144.

To carry out the method of treating the carbonaceous material utilized in heat exchanger apparatus 110 of FIG. 4, carbonaceous material is charged into the chamber 114 through inlets 116 which feed directly into the chamber after insuring that the valve 126 located at the lower end of the chamber is closed. Upon filling the various sections of the chamber with carbonaceous material, the valves 118 located along the inlets 116 are shut to maintain the carbonaceous material in a closed system within the chamber. Subsequently, steam is optionally, but preferably, introduced through the injector 130 which, in turn, substantially evenly distributes the steam throughout the various sections of the chamber. By distributing the steam evenly throughout each chamber section, the steam is allowed to condense relatively evenly on the carbonaceous material.

Ideally, the pressure at which the steam is maintained within the chamber 114 will be on the order of between about 2 PSIG to about 3000 PSIG depending mainly upon the btu requirements for any given charge of carbonaceous material. As the steam condenses and moves downwardly throughout the carbonaceous material, the divider 140 serves to insure that the amount of condensing steam in any one section is roughly equivalent to that contained in another section. As a result of the even distribution of steam throughout the chamber, higher consistency can be achieved with regard to the treated carbonaceous material.

Once the steam has been optionally introduced, the gaseous mixture is continuously introduced for a period of up to about thirty minutes at a pressure of between about 2 PSIG to about 3000 PSIG depending largely on the quantity and moisture content of the carbonaceous material as originally charged into the heat exchanger. The gaseous mixture as noted in FIGS. 5–7 preferably comprises about 90.0% inert gas and 10.0% oxygen wherein the inert gas preferably is nitrogen.

After treating the carbonaceous material for a sufficient amount of time, the valves 122 and 126, respectively, are opened to vent any gases such as hydrogen sulfide gas which has been generated as a result of the condensing steam reacting with the carbonaceous material. Further, any by-products in the form of contaminant borne water are also recoverable through valve 126. After the gases and other by-products have been discharged, the carbonaceous material can then be recovered through the one or more outlets 120 provided along the lower end of the heat exchanger apparatus.

Figure 5:
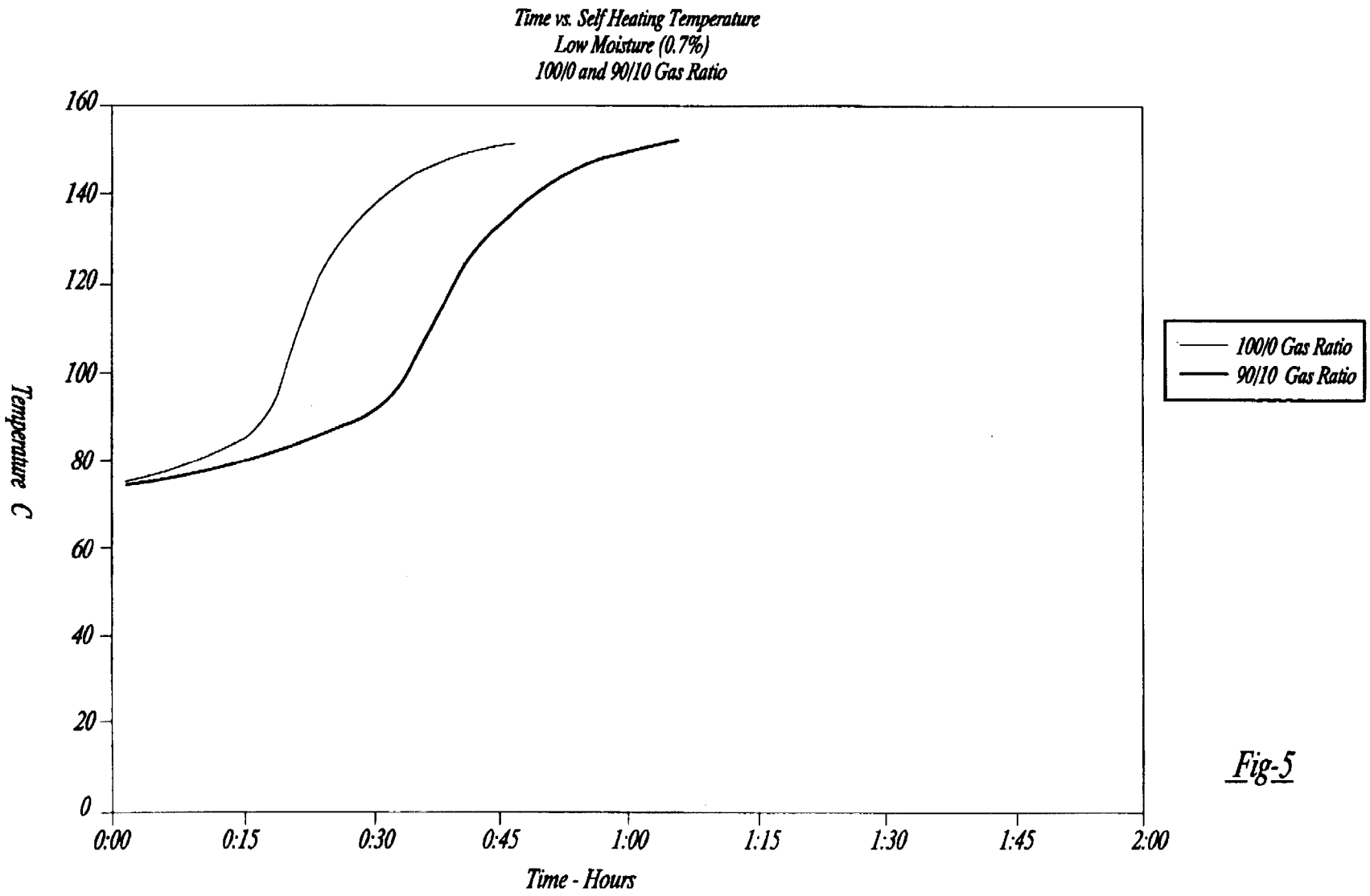
FIG. 5 is a graph illustrating the self heating temperature of a sample treated via a process in accordance with the teachings of the present invention.
Figure 6:
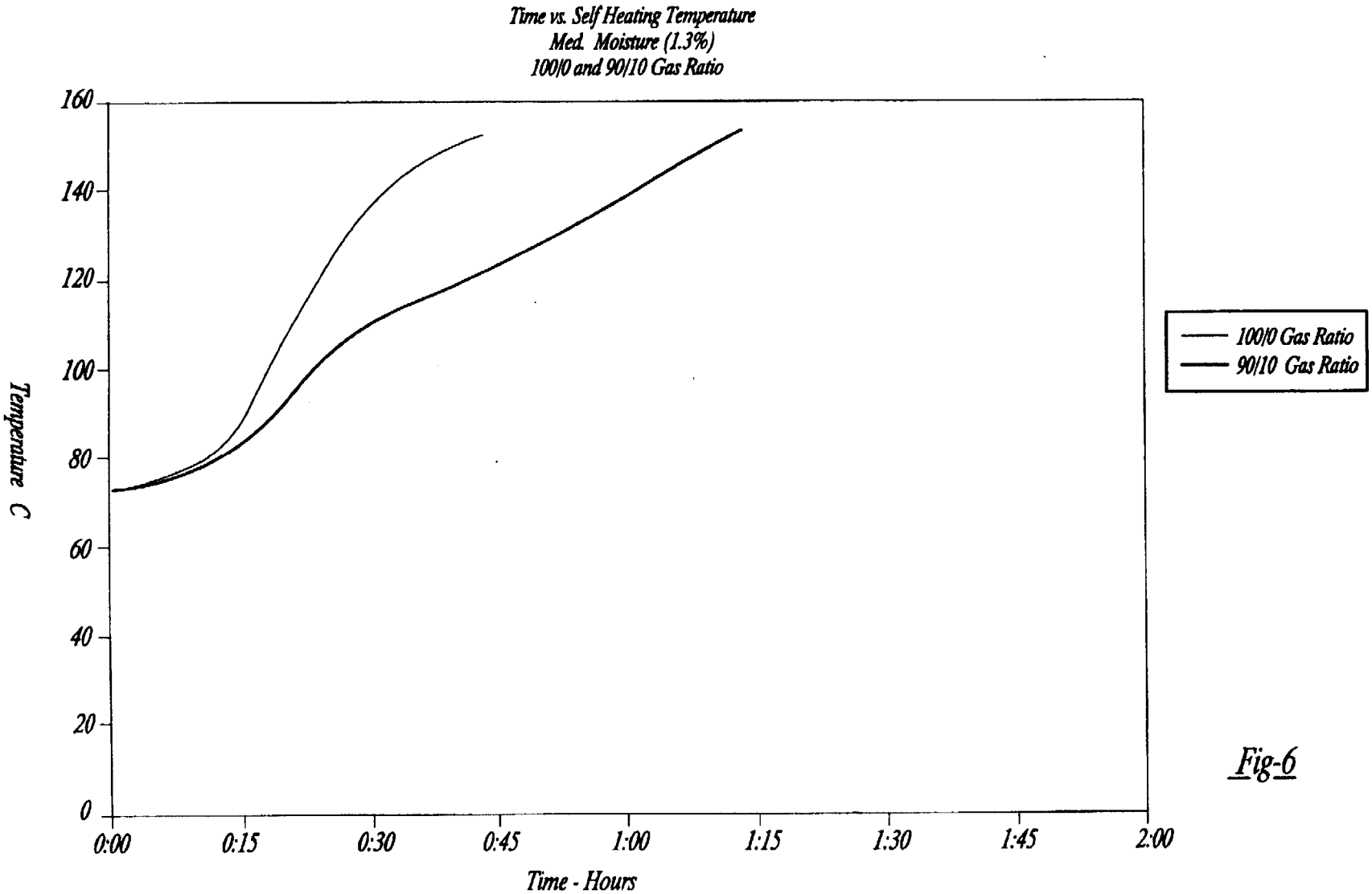
FIG. 6 is a graph illustrating the self heating temperature of a sample treated via a process in accordance with the teachings of the present invention.
Figure 7:
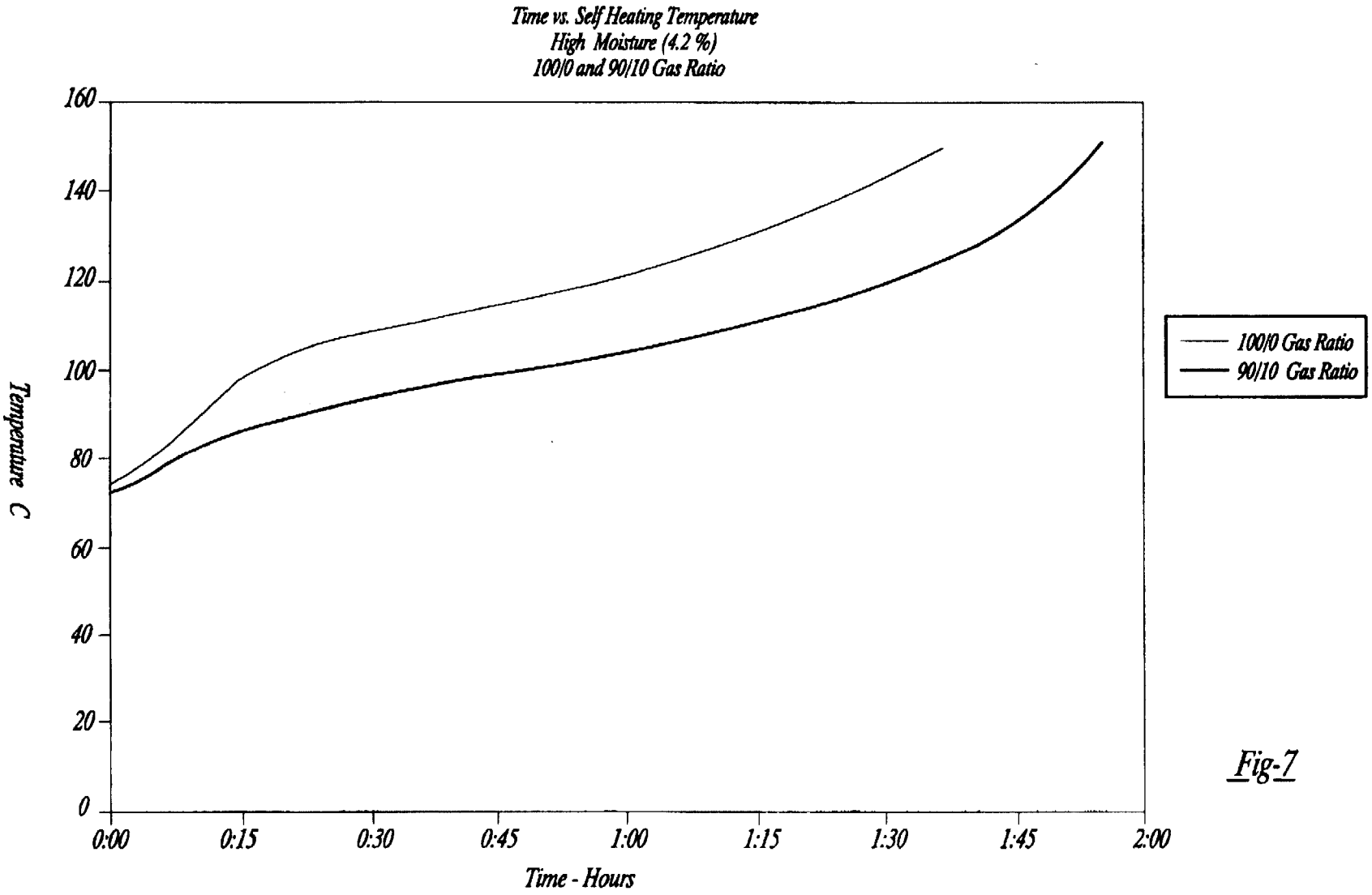
FIG. 7 is a graph illustrating the self heating temperature of a sample treated via a process in accordance with the teachings of the present invention.

Referring to FIGS. 5–7, various graphs are provided which illustrate the results of combustion tests run on a population of carbonaceous material samples having variable moisture contents. By "population," it is meant that the averages for three different compositions having the same moisture content were tested for self heating temperatures with the sum average being displayed after the introduction of 100.0% nitrogen and a gaseous mixture of 90.0% nitrogen/10.0% oxygen by volume, respectively.

Referring particularly to FIG. 5, the graph presented therein illustrates the result of a time versus self heating temperature for a population of low moisture content carbonaceous material. As with each of the test samples, the starting temperature of the carbonaceous material was 75° C. and the test apparatus was set at a target temperature of 150° C. As illustrated in FIG. 5, the samples treated in the presence of $N_2$ (as indicated by the lighter colored plot line) attained a temperature of about 138° C. in thirty minutes whereas the samples treated with a gaseous mixture of 90.0% $N_2$–10.0% $O_2$ attained a temperature of only about 88° C. (as indicated by the darker plot line) at thirty minutes. Further, the samples treated with $N_2$ only attained the target temperature of 150° C. in 47 minutes whereas the sample treated with 90.0% $N_2$–10.0% $O_2$ took one hour and eight minutes.

Referring to FIGS. 6 and 7, the graphs presented relate to test sample pollutions having increasingly higher moisture contents. While it can generally be said that an increasing moisture content extends the time period required to reach the target temperature of 150° C. for each sample population, even with the increased moisture content, the samples treated with the gaseous mixture of 90.0% $N_2$–10.0% $O_2$ required significantly longer periods of heating than those samples treated with 100.0% $N_2$ having the same moisture content.

Based on the results of the self heating tests, it can be surmised that carbonaceous materials, i.e. upgraded carbonaceous materials, treated with the gaseous mixture including a major amount of inert gas and a minor amount of oxygen are more resistant to undesired combustion than upgraded carbonaceous materials treated in the presence of inert gas alone.

The skilled practitioner will realize still other advantages of the invention after having the benefit of studying the specification, drawings and following claims.

What is claimed is:

1. A process for treating moist carbonaceous material to render the material resistant to undesired combustion, comprising the steps of: preheating the carbonaceous material to convert the moisture contained therein into superheated steam; and then applying a gaseous mixture to the preheated carbonaceous material for up to about thirty minutes, said gaseous mixture comprising a major amount of inert gas and a minor amount of oxygen.

2. The process of claim 1, wherein said gaseous mixture includes up to about 20.0% oxygen based on the total volume.

3. The process of claim 2, wherein said gaseous mixture includes between about 5.0% to about 15.0% oxygen based on the total volume of the gaseous mixture.

4. The process of claim 1, wherein said inert gas includes at least about 60.0% nitrogen based on the volume of the inert gas.

5. The process of claim 4, wherein said inert gas includes at least about 90.0% nitrogen based on the volume of the inert gas.

6. The process of claim 1, wherein said gaseous mixture comprises about 90.0% nitrogen and about 10.0% oxygen.

7. The process of claim 1, wherein the gaseous mixture is introduced at a rate of about 50 to 250 PSIG.

8. The product produced by the process of claim 1.

9. The product of claim 8, wherein said product has an average fuel volume of about 12,000 btu/lb.

10. A process for producing upgraded carbonaceous materials wherein the resulting product is resistant to undesired combustion, comprising the steps of:

(a) providing a heat exchanger including an outer casing and an inner chamber, an inlet for introducing carbonaceous material into either the outer casing or the inner chamber, an outlet for removing the carbonaceous material from said outer casing or said inner chamber and at least one inlet for introducing a gaseous mixture comprising a major amount of inert gas and a minor amount of oxygen into said outer casing or inner chamber containing said carbonaceous material;

(b) circulating a heat exchange medium having a temperature of at least 250° F. through either of said outer casing or inner chamber not containing the carbonaceous material to effectuate an increase in the temperature of said carbonaceous material;

(c) introducing said gaseous mixture into the heat exchanger portion including the carbonaceous material; and (d) recovering the carbonaceous material through said outlet.

11. The process of claim 10, wherein said gaseous mixture includes up to about 20.0% oxygen based on the total volume.

12. The process of claim 11, wherein said gaseous mixture includes between about 5.0% to about 15.0% oxygen based on the total volume of the gaseous mixture.

13. The process of claim 10, wherein said inert gas includes at least about 60.0% nitrogen based on the volume of the inert gas.

14. The process of claim 13, wherein said inert gas includes at least about 90.0% nitrogen based on the volume of the inert gas.

15. The process of claim 10, wherein said gaseous mixture comprises about 90.0% nitrogen and about 10.0% oxygen.

16. The process of claim 10, wherein the gaseous mixture is introduced at a pressure of between about 50 PSIG to about 250 PSIG.

17. The product produced by the process of claim 10.

18. The product of claim 17, wherein said product has an average fuel volume of about 12,000 btu/lb.

* * * * *